US007554034B2

(12) United States Patent
Smith

(10) Patent No.: US 7,554,034 B2
(45) Date of Patent: Jun. 30, 2009

(54) WEATHERPROOF CONNECTOR

(76) Inventor: Kenneth Smith, 3900 15th Pl. West, Seattle, WA (US) 98119

( * ) Notice: Subject to any disclaimer, the term of this patent is extended or adjusted under 35 U.S.C. 154(b) by 0 days.

(21) Appl. No.: 11/864,314

(22) Filed: Sep. 28, 2007

(65) Prior Publication Data

US 2009/0084572 A1 Apr. 2, 2009

(51) Int. Cl.
*H01H 9/02* (2006.01)

(52) U.S. Cl. ..... 174/53; 174/54; 174/66; 174/57; 174/135; 439/490; 439/137; 220/296

(58) Field of Classification Search ..... 174/53, 174/54, 57, 135, 66, 67; 439/137, 142, 135, 439/358, 357, 490, 489, 910; 220/296, 241, 220/242

See application file for complete search history.

(56) References Cited

U.S. PATENT DOCUMENTS 4,138,187 A * 2/1979 Brygger ..... 439/142
5,567,175 A * 10/1996 Warden et al. ..... 439/490

* cited by examiner

*Primary Examiner*—Dhiru R Patel
(74) *Attorney, Agent, or Firm*—Robert A. Jensen; Jensen & Puntigam, P.S.

(57) ABSTRACT

A weatherproof power inlet box and mating plug wherein the inlet box and mating plug are asymmetrical, positively latched and include more robust elements and a visual indicator of the status of the interconnect. Also included is a thermostat that trips to prevent overheating.

1 Claim, 4 Drawing Sheets

WEATHERPROOF CONNECTOR

TECHNICAL FIELD

This invention relates to a weatherproof connector and more particularly to a weatherproof connector system wherein the electrical connector portions when properly connected, interlock to prevent accidental disconnect and visually indicate the status of the connection. Also incorporated is a thermostat to break connection in the event of overheating.

BACKGROUND OF THE INVENTION

Electrical interconnects have been available and are used principally to supply power to camping vehicles and boats when at dock. The standard electrical interconnect includes projecting prongs which must be aligned with the appropriate receptacle as well as a bayonet type securement device to prevent inadvertent dislodge of the interconnect. These known devices have been known to malfunction because of the continuous motion as on a boat, thereby causing overheating and perhaps fire. Examples of known interconnects are shown in U.S. Pat. No. 5,118,301, granted to Bentivolio Jun. 2, 1992, which serves as an interconnect between matched female connector devices.

U.S. Pat. No. 5,984,719, granted to Flegel Nov. 16, 1999, discloses an auxiliary power supply system but also discloses a standard electrical interconnect.

Likewise, U.S. Pat. No. 6,163,449 granted to Flegel Dec. 19, 2000, utilizes a standard electric interconnect.

DISCLOSURE OF THE INVENTION

With the above-noted prior art in mind, an electric interconnect is provided wherein the mating of the two parts is predetermined by the configuration of the mating parts, thereby preventing any inadvertent incorrect interconnect.

Further the inventive device includes not only a more robust interconnect element, but also a failsafe securement method in addition to superior sealing from the weather.

The inventive device includes a superior cover and LEDs to indicate the status of the interconnect, i.e., polarity and/or power presence.

It also includes a thermostat to guard against overheating.

BEST MODE FOR CARRYING OUT THE INVENTION

Figure 1:
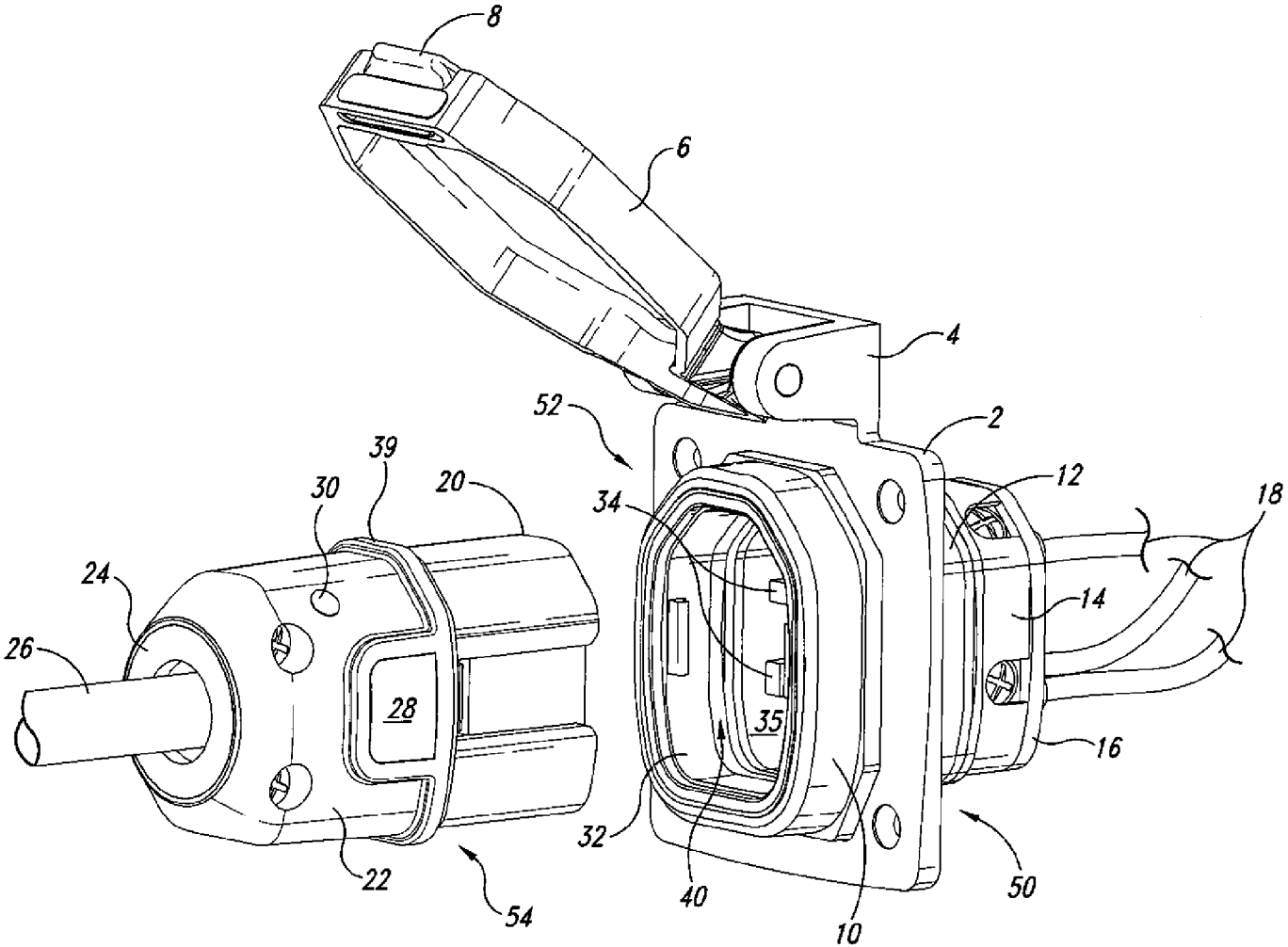
FIG. 1 is an isometric view of the inventive interconnect device.

As seen in FIG. 1, the unit fixed to the vehicle or structure is a weatherproof power inlet or receptacle box 50 comprising a wall mounted female unit 52 which includes a mounting plate 2 for securement to a wall including an outwardly extending hinge element 4 to which is mounted a weather cover 6 including a latch 8. Secured to the mounting plate is front flange 10, a rear flange 12, a receptacle base 14 and a receptacle cover 16 through which extend a plurality of wires 18. Likewise seen in this view is a removable male unit or plug 54, the connector receptacle 20, the housing 22, the cap 24 and input wire 26. Likewise seen in this view is a release button 28 and a light emitting diode (LED) 30.

The connector receptacle 20 is received within the opening 32 surrounded by the front flange 10. Further seen in this view are the male connector elements 34 which are robust extending outwardly from rear wall 35.

Figure 2:
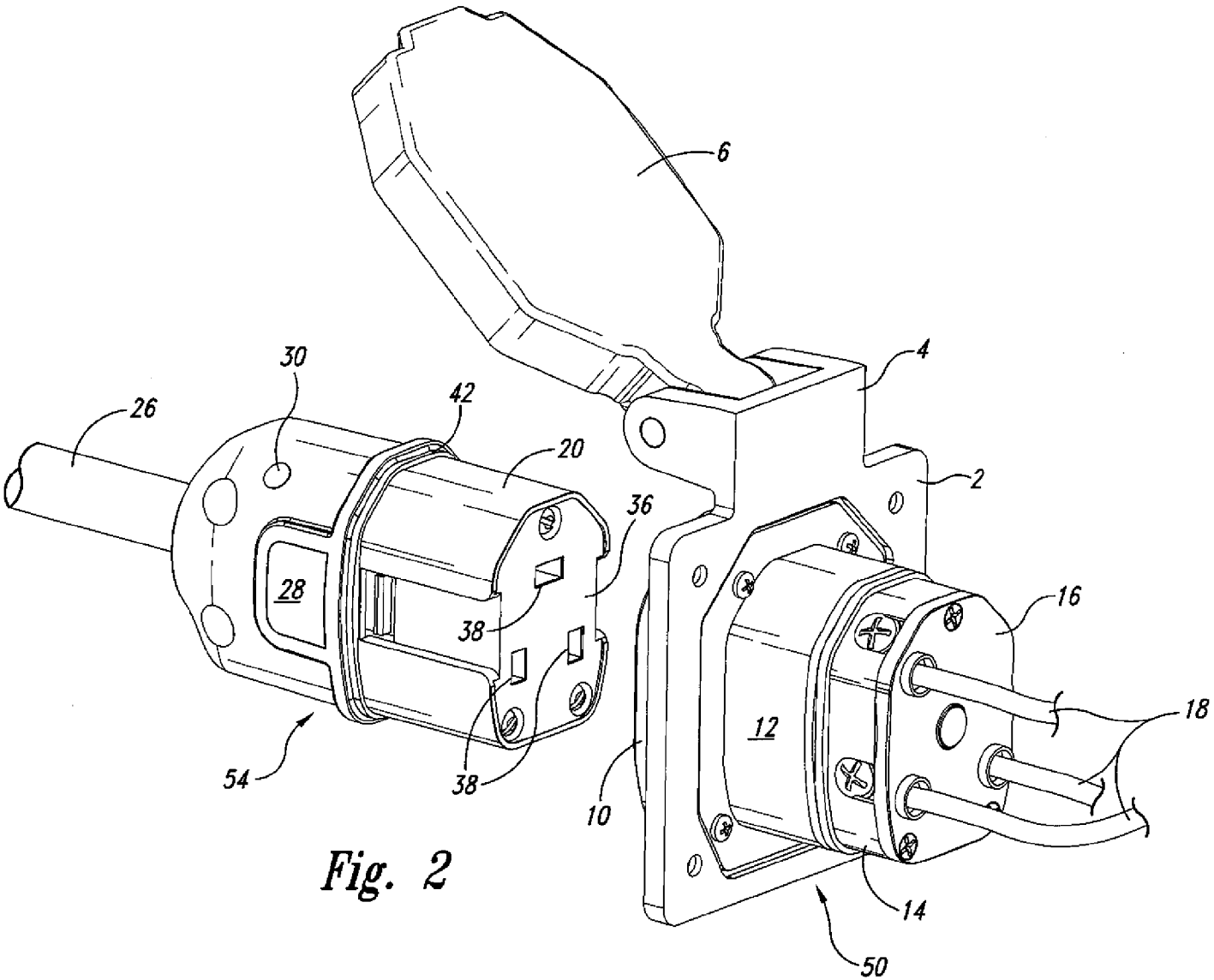
FIG. 2 is an isometric view of the interconnect device looking in the opposite direction.

Referring now to FIG. 2, similar parts are identified with the identical number and it is further to be seen that within the connector receptacle 20 is the actual connector 36 having openings 38 to receive male connector members 34. The rear portion 39 of plug 54 is larger than the front portion to accommodate gasket 42.

Further to be seen in FIGS. 1 and 2 are sealing gasket members 40 and 42 which are engaged when the receptacle is in the closed position preventing the influx of any liquid. It is to be noted that opening 32 and receptacle so one asymmetrical preventing an unaligned connection.

Figure 3:
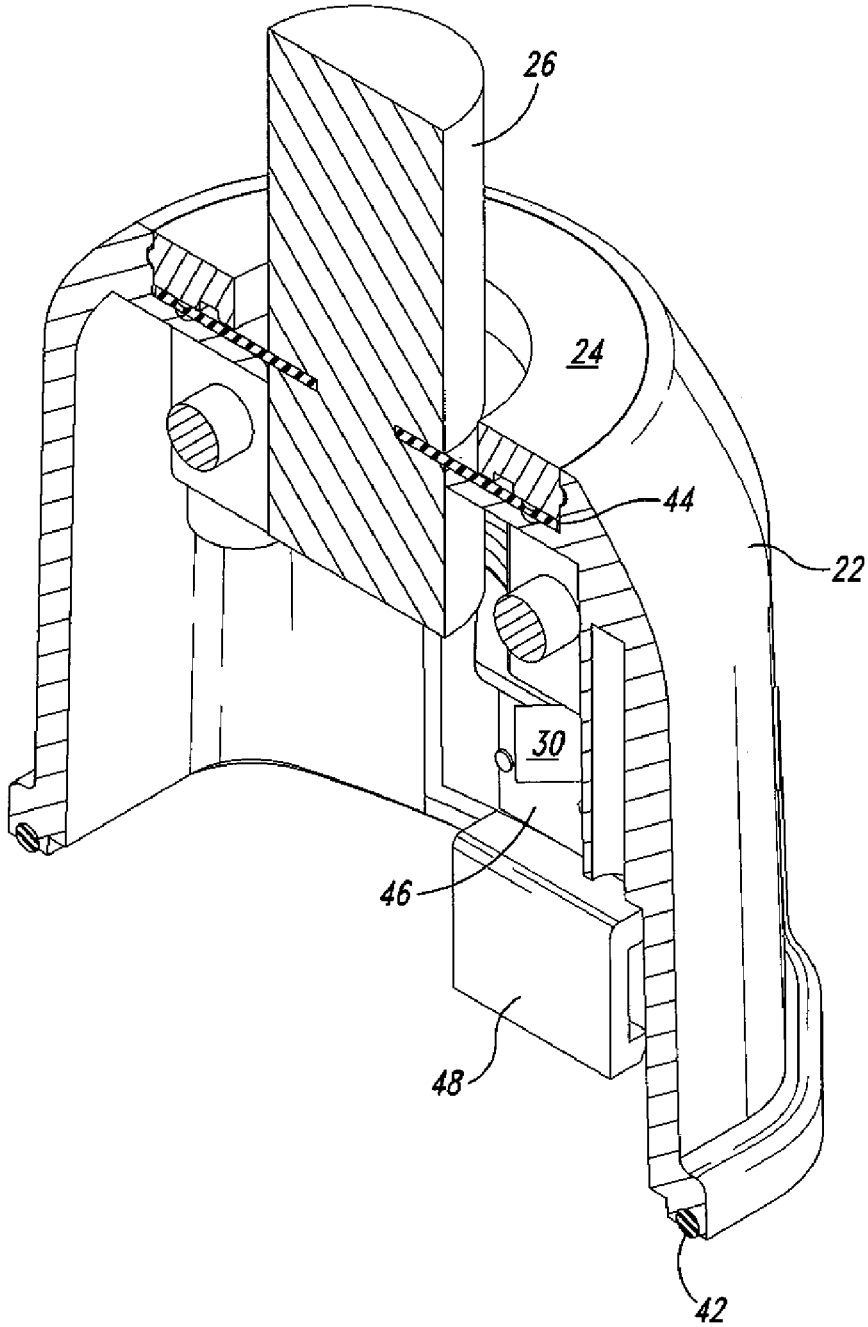
FIG. 3 is a sectional view through the housing for the female element.

As seen in FIG. 3, in addition to the cap 24 on the housing 22, there is a seal 44 which surrounds the input wire 26. Also seen in this view is a spring 46 which urges the button 28 (not shown) outwardly and the button 28 is integral with the snap fastener element 48.

Figure 4:
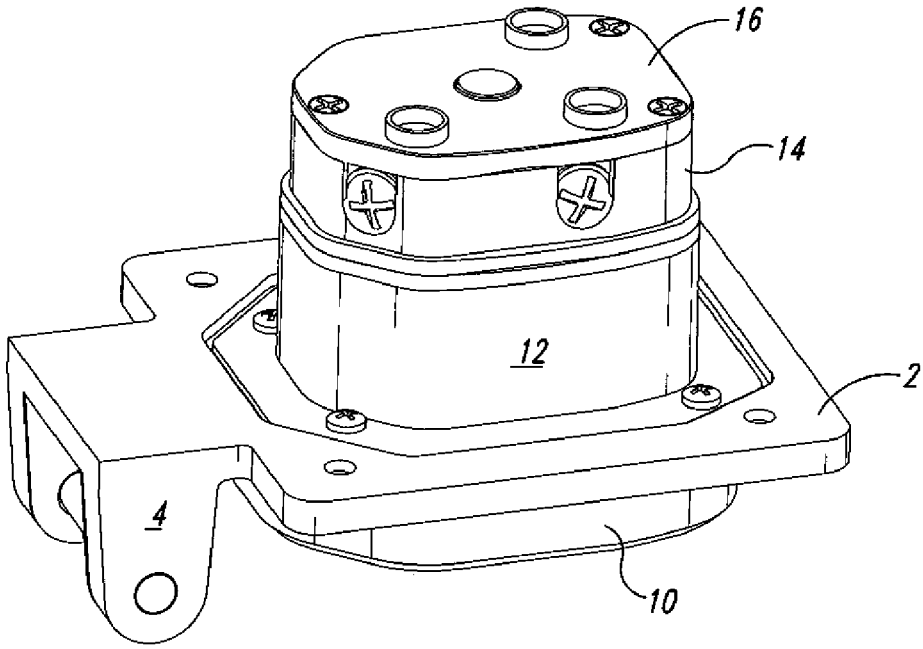
FIGS. 4 and 5 are isometric views of the receptacle base and housing therefor.
Figure 5:
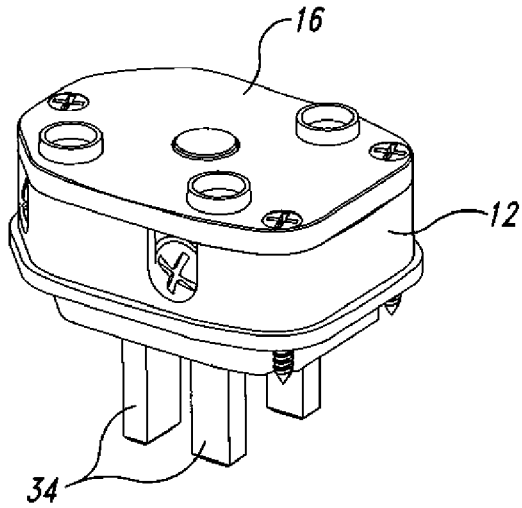

FIGS. 4 and 5 more clearly illustrate the components of the receptacle.

As thus can be seen, the present invention provides a safer, more secure power input for motor vehicles and/or boats.

The invention claimed is:

1. A weatherproof electrical outlet system, comprising: a first wall-mounted unit comprising a substantially planar mounting element for securing the unit to a wall, including an outwardly projecting hinge element and an outwardly projecting flange surrounding an opening which is irregular in cross-section and has a rear wall which includes electrical interconnect elements projecting therefrom;

a cover element hingedly secured to the hinge element movable from a first position encapsulating and sealing said flange to a second position permitting access to the opening; a second portable unit, including a front portion to snugly fit into the opening in the first wall-mounted unit and receptacles to receive the electrical interconnect elements and a rear portion larger than the front portion and including a gasket member to form a seal with the flange when interconnected with the first wall-mounted unit; and fastening means including snap fastener elements to secure the second portable unit in the interconnect position, whereby the outlet system is weatherproof and secure.

* * * * *